US007740331B2

(12) United States Patent
Koo

(10) Patent No.: US 7,740,331 B2
(45) Date of Patent: Jun. 22, 2010

(54) REFRIGERATOR RECEPTACLE

(75) Inventor: Min Bon Koo, Changwon (KR)

(73) Assignee: LG Electronics Inc., Seoul (KR)

( * ) Notice: Subject to any disclaimer, the term of this patent is extended or adjusted under 35 U.S.C. 154(b) by 911 days.

(21) Appl. No.: 11/502,407

(22) Filed: Aug. 11, 2006

(65) Prior Publication Data

US 2007/0035221 A1 Feb. 15, 2007

(30) Foreign Application Priority Data

Aug. 11, 2005 (KR) ..... 10-2005-0073956
Aug. 11, 2005 (KR) ..... 10-2005-0073957
Aug. 11, 2005 (KR) ..... 10-2005-0073958
Aug. 11, 2005 (KR) ..... 10-2005-0073984

(51) Int. Cl.
*A47B 88/04* (2006.01)

(52) U.S. Cl. ..... 312/404; 312/402

(58) Field of Classification Search ..... 312/299, 312/301, 334.1, 334.44, 334.8, 902, 298, 312/308, 408, 401, 402, 404, 330.1, 333; 220/23.83, 23.6, 571.1, 572; 403/331; 211/126.15; 62/302, 449, 441, 382, 440
See application file for complete search history.

(56) References Cited

U.S. PATENT DOCUMENTS 2,103,885 A * 12/1937 Whalen ..... 312/404
2,517,725 A * 8/1950 Schweller ..... 312/334.23
2,682,754 A * 7/1954 Eck ..... 62/531
2,801,146 A * 7/1957 Mikulas ..... 312/301
2,997,355 A * 8/1961 Preble ..... 312/334.18
3,063,772 A * 11/1962 Kennedy ..... 312/308
3,169,813 A * 2/1965 Cannon et al. ..... 312/270.3
3,245,742 A * 4/1966 Lampman ..... 312/304
3,751,126 A * 8/1973 Hudson ..... 384/23
3,826,404 A * 7/1974 Rowe et al. ..... 220/604
4,479,684 A * 10/1984 Doyel ..... 312/330.1
4,638,908 A * 1/1987 Baitz et al. ..... 206/0.8
4,751,826 A * 6/1988 Kawahara et al. ..... 62/382
4,788,832 A * 12/1988 Aoki et al. ..... 62/382
4,936,641 A * 6/1990 Bussan et al. ..... 312/408
5,040,856 A * 8/1991 Wilkins et al. ..... 312/402
5,086,936 A * 2/1992 Remmers ..... 211/126.15
5,462,348 A * 10/1995 Ellingson et al. ..... 312/301

(Continued)

FOREIGN PATENT DOCUMENTS

JP 10-068580 3/1998

(Continued)

*Primary Examiner*—James O Hansen
(74) *Attorney, Agent, or Firm*—Ked & Associates LLP

(57) ABSTRACT

Disclosed is a refrigerator receptacle including a first tray adapted to move into/out of a storage space like a drawer, a reception space being defined in the first tray, the reception space having an upward opening; a second tray adapted to move in an inward/outward movement direction of the first tray, a reception space being defined in the second tray, the reception space having an upward opening; a guide member for guiding movement of the second tray, an insertion groove being formed on the guide member, an upper end of both lateral surfaces of the first tray being inserted into the insertion groove; and a fastener extending through one of the first tray and the guide member so as to be fastened to other of the first tray and the guide member.

6 Claims, 7 Drawing Sheets

U.S. PATENT DOCUMENTS 5,540,342 A * 7/1996 Rathbun ..... 215/225
5,586,817 A * 12/1996 Hubbard et al. ..... 312/334.44
5,641,217 A * 6/1997 Caruso et al. ..... 312/404
5,820,239 A * 10/1998 Christenson et al. ... 312/334.23
5,980,009 A * 11/1999 Atalla et al. ..... 312/408
6,056,378 A * 5/2000 Semon et al. ..... 312/246
6,124,572 A * 9/2000 Spilger et al. ..... 219/400
6,641,239 B2 * 11/2003 Kaiser ..... 312/404
6,851,775 B2 * 2/2005 Kaiser ..... 312/404
6,938,617 B2 * 9/2005 Le et al. ..... 126/339
7,228,704 B2 * 6/2007 Rand et al. ..... 62/382
2001/0054296 A1 * 12/2001 Kaiser ..... 62/373
2004/0056573 A1 * 3/2004 Chae ..... 312/404
2005/0061021 A1 * 3/2005 Uihlein et al. ..... 62/441
2005/0156494 A1 * 7/2005 Bergmann et al. ..... 312/404

FOREIGN PATENT DOCUMENTS

JP 2004-003856 1/2004

* cited by examiner

REFRIGERATOR RECEPTACLE

BACKGROUND OF THE INVENTION

1. Field of the invention

The present invention relates to a refrigerator, and more particularly to a refrigerator receptacle removably installed in a storage space of a refrigerator so as to contain food.

2. Description of the Prior Art

FIG. 6 is an exploded perspective view showing a conventional refrigerator receptacle.

Referring to the drawing, a refrigerator body 10 has a storage space 11 defined therein. The storage space 11 has a front opening, as well as fixed rails 13 positioned on both lateral surfaces thereof while being elongated forwards and backwards. Support rods 15 are positioned on both lateral surfaces of the storage space 11 above the fixed rails 13.

The body 10 has a door 17 for exposing/covering the storage space 11, a door handle 19 positioned on the front surface of the door 17 near its top, and a tray 21 fixed to the rear surface of the door 17. The tray 21 can be moved into/out of the storage space 11 like a drawer. The tray 21 has a reception space 23 defined therein.

The door 17 has fixed rails 25 extending from its rear surface so that the tray 21 can be moved like a drawer. Particularly, the fixed rails 25 are supported by the fixed rails 13 in such a manner that the fixed rails 25 can slide forwards/backwards.

A basket 27 is supported by the support rods 15 so that it can be moved into/out of the storage space 11 like a drawer while being positioned above the tray 21. The basket 27 has a reception space 29 defined therein. Both ends of the basket 27 are supported by the support rods 15 so as to slide thereon.

The operation of the conventional refrigerator receptacle, which is constructed as above, will now be described.

In order to get food contained in the reception space 23 of the tray 21, the user grasps the door handle 19 by hand and pulls the door 17 to the front of the body 10 so that the storage space 11 is exposed. The tray 21 is then moved forwards out of the storage space 11 together with the door 17. The food contained in the reception space 23 of the tray 21 is now accessible.

When the user wants to get food contained in the reception space 29 of the basket 27, he pulls the tray 21 out of the storage space 11 and exposes the storage space 11 in a similar manner. The basket 27 is then drawn forwards out of the storage space 11 so that the food is accessible.

However, the conventional refrigerator receptacle has the following problems.

In order to get food contained in the reception space 29 of the basket 27, it is necessary not only to pull the door 17 so that the tray 21 is drawn out of the storage space 11, but also to pull the basket 27 out of the storage space 11. After the food is removed, the basket 27 must be pushed into the storage space 11. As such, the process for getting food contained in the reception space 29 of the basket 27 is complicated and inconvenient.

In addition, when the basket 27 is moved into or out of the storage space 11, it may collide with the food contained in the reception space 23 of the tray 21. This means that the food in the reception space 23 may interfere with the basket 27 on the move.

SUMMARY OF THE INVENTION

Accordingly, the present invention has been made to solve the above-mentioned problems occurring in the prior art, and an object of the present invention is to provide a refrigerator receptacle adapted so that food can be easily put therein and got therefrom.

Another object of the present invention is to provide a refrigerator receptacle adapted so that the movement of a tray is not interfered with by food.

In order to accomplish these objects, there is provided a refrigerator receptacle including a first tray adapted to move into/out of a storage space like a drawer, a reception space being defined in the first tray, the reception space having an upward opening; a second tray adapted to move in an inward/outward movement direction of the first tray, a reception space being defined in the second tray, the reception space having an upward opening; a guide member for guiding movement of the second tray, an insertion groove being formed on the guide member, an upper end of both lateral surfaces of the first tray being inserted into the insertion groove; and a fastener extending through one of the first tray and the guide member so as to be fastened to other of the first tray and the guide member.

In accordance with another aspect of the present invention, there is provided a refrigerator receptacle including a basket adapted to move into/out of a storage space, a reception space being defined in the basket so as to contain food, a pair of interlocking protrusions being positioned on an upper end of both lateral surfaces of the basket while being spaced a predetermined distance in forward and backward directions, and a tray adapted to move into/out of the storage space while being interlocked with inward/outward movement of the basket, a reception space being defined in the tray so as to contain food, the tray having a latching protrusion adapted to be pushed toward an inside or outside of the storage space by the interlocking protrusions when the basket is moved into/out of the storage space, the tray having a buffering member for enclosing the latching protrusion, wherein the latching protrusion is adapted to be pushed by the interlocking protrusions when the basket is moved into/out of the storage space so that the tray is moved inwards/outwards while being interlocked with the inward/outward movement of the basket, and the buffering member is adapted to absorb external force acting on the latching protrusion when the tray is moved into/out of the storage space while being interlocked with the inward/outward movement of the basket.

In accordance with another aspect of the present invention, there is provided a refrigerator receptacle including guide ribs positioned on both lateral surfaces of a tray adapted to move into/out of a storage space while being interlocked with inward/outward movement of a basket adapted to move into/out of the storage space, the guide ribs sliding along an upper end of the basket and along guide frames positioned on both sides of the storage space; a latching protrusion positioned on a side of a bottom surface of the guide ribs, the latching protrusion being pushed toward an inside or outside of the storage space by a pair of interlocking protrusions positioned on the upper end of the basket when the basket is moved into/out of the storage space; and a buffering member positioned on the bottom surface of the guide ribs while being adjacent to the latching protrusion, the buffering member absorbing external force acting on the latching protrusion when the tray is moved into/out of the storage space while being interlocked with the inward/outward movement of the basket.

The inventive refrigerator receptacle is advantageous as follows: food can be put in the storage space or removed therefrom in an easy and convenient manner; food contained in the first tray is not damaged by the second tray when the first tray moves inwards/outwards, and vice versa; and minimum noise is generated by the trays when they are moved into/out of the storage space.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
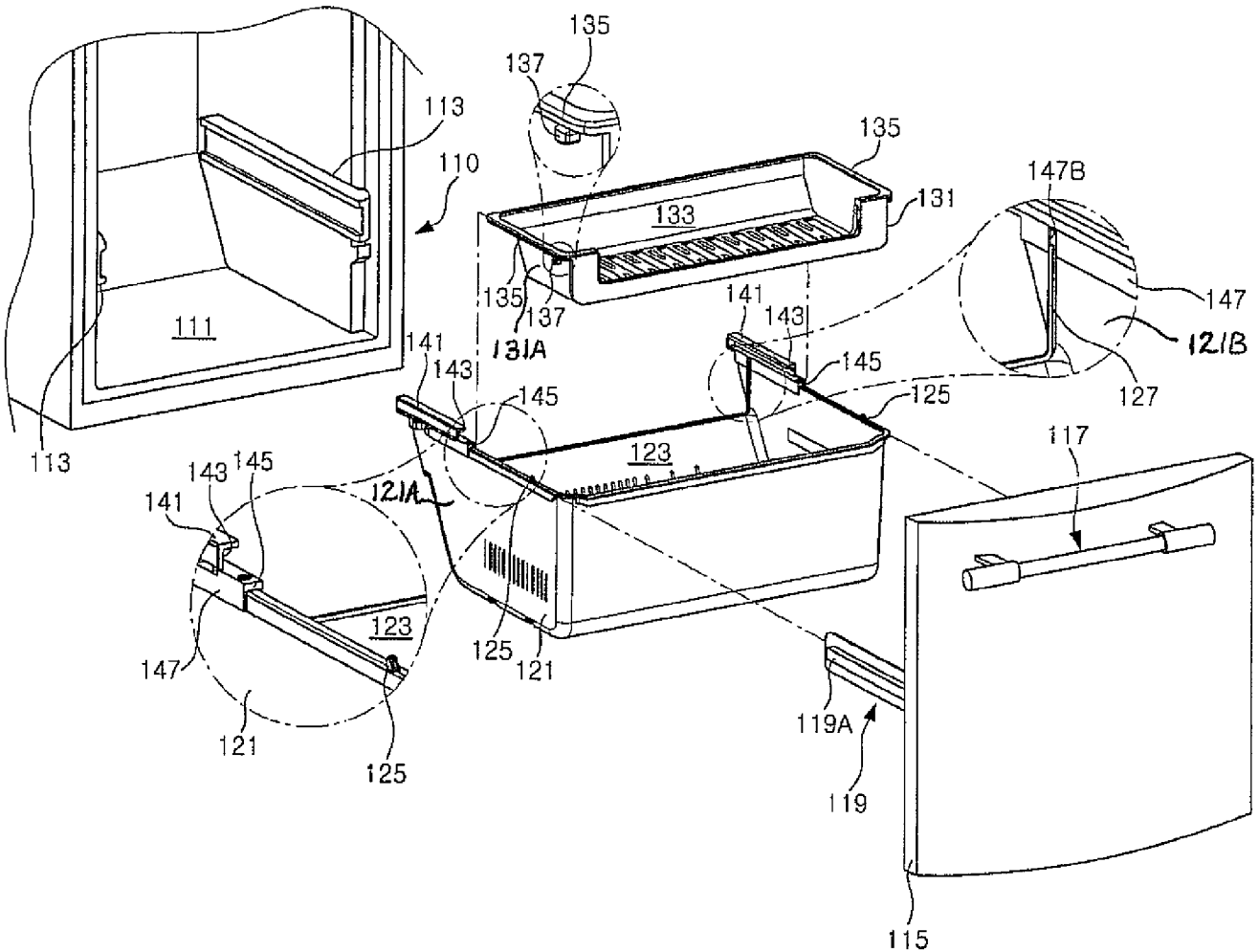
FIG. 1 is an exploded perspective view showing a refrigerator receptacle according to a first embodiment of the present invention.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
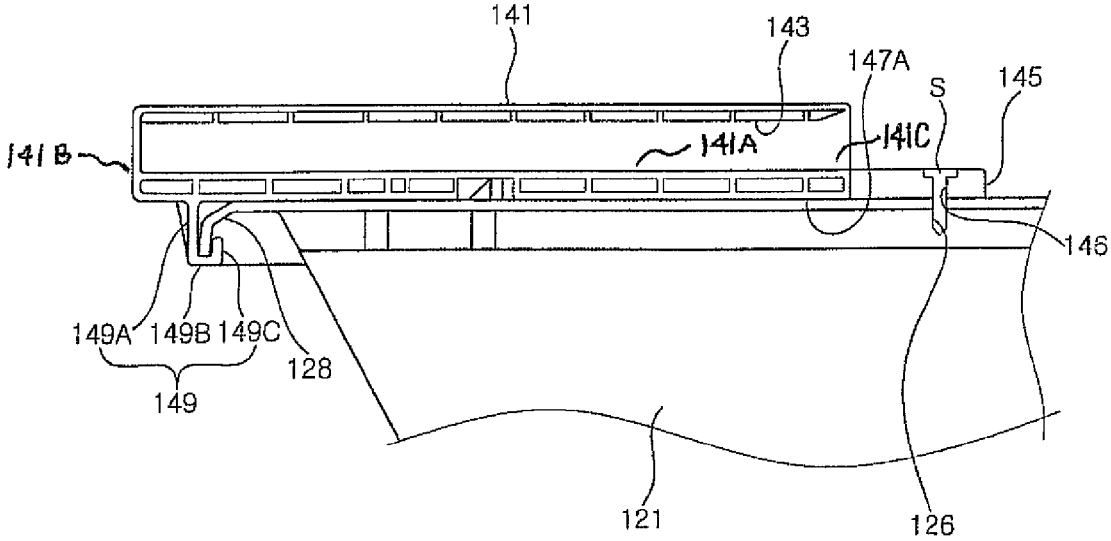
FIG. 2 is a lateral sectional view showing a first tray and a guide member according to the first embodiment of the present invention.

FIG. 1 is an exploded perspective view showing a refrigerator receptacle according to a first embodiment of the present invention, and FIG. 2 is a lateral sectional view showing a first tray and a guide member according to the first embodiment of the present invention.

Referring to the drawings, a refrigerator body 110 has fixed rails 113 positioned on both lateral surfaces of a storage space 111, respectively, in order to guide the movement of a first tray 121 (described later). Particularly, the fixed rails 113 are elongated in the forward and backward directions of the storage space 111 so that the first tray 121 can be moved in the same directions.

The refrigerator body 110 has a door 115 for selectively exposing/covering the storage space 111, a door handle 117 positioned on the front surface of the door 115 near its top to be grasped by the user manually, and movable rails 119 extending from the rear surface of the door 115 so that the first tray 121 can be moved like a drawer.

The movable rails 119 consist of a fixed portion (not shown) fixed to the rear surface of the door 115 and a pair of connection portions 119A extending backwards from both ends of the fixed portion in a direction perpendicular to the fixed portion. The connection portions 119A are adapted to slide along the fixed rails 113 with their inner surfaces fastened to both outer surfaces of the first tray 121, respectively.

The first tray 121 is positioned on the rear surface of the door 115. The first tray 121 has the shape of a hexahedron with an upward opening. The first tray 121 has a reception space 123 defined therein. The reception space 123 has an upward opening so that food can be contained therein. The first tray 121 has latching protrusions 125 positioned on the front end of the top of both lateral surfaces 121A thereof, respectively, and fastening holes 126 formed approximately at the center of the top of both lateral surfaces 121A thereof, as shown in FIG. 2.

The latching protrusions 125 protrude a predetermined distance in the upward direction from the top of both lateral surfaces 121A of the first tray 121, in order to prevent a second tray 131 (described later) from moving beyond a predetermined range in the same direction as the first tray 121 is moved. Fasteners S are fastened to the fastening holes 126, respectively, so that guide members 141 (described later) are fixed to the first tray 121.

The first tray 121 has insertion protrusions 127 positioned on both inner surfaces thereof between the rear end thereof and the fastening holes 126. The insertion protrusions 127 protrude a predetermined distance from both inner surfaces of the first tray 121 towards each other while being elongated in the vertical direction. The insertion protrusions 127 are inserted into insertion slots 147B of the guide members 141.

Referring to FIG. 2, the first tray 121 has fastening protrusions 128 positioned on the rear end of the top of both lateral surfaces 121A thereof, respectively. The fastening protrusions 128 engage with fastening hooks 149 of the guide members 141, respectively, so that the guide members 141 remain fixed. The fastening protrusions 128 extend from the rear end of the top of both lateral surfaces 121A of the first tray 121 at a downward angle, i.e. in an oblique rearward direction.

The second tray 131 is positioned on top of the first tray 121. The second tray 131 is adapted to move in the same direction as the first tray 121, i.e. in the forward or backward direction of the storage space 111. The second tray 131 has the shape of a flat hexahedron with upward and forward openings. The length (measured in the forward and backward directions) and height of the second tray 131 are smaller than those of the first tray 121, but the width (measured in a direction perpendicular to the forward and backward directions) of the second tray 131 is equal to that of the first tray 121. The second tray 131 has a reception space 133 defined therein. The top and front surfaces of the reception space 133 are partially open so that food can be contained therein.

The second tray 131 has guide ribs 135 positioned on the top of both lateral surfaces 131A thereof, respectively, while being elongated in the longitudinal direction thereof. The guide ribs 135 extend a predetermined distance outwards from the top of both lateral surfaces 131A thereof to be inserted into guide slots 143 of the guide members 141.

Each guide rib 135 has a stopper 137 positioned on the front end of its bottom surface, in order to limit the range of movement of the second tray 131 relative to the first tray 121. The stoppers 137 protrude a predetermined distance in the downward direction from the bottom surface of the guide ribs 135. The second tray 131 moves forwards relative to the first tray 121 until the stoppers 137 abut the latching protrusions 125 and moves backwards until the stoppers 137 abut latching steps 145 of the guide members 141.

The guide members 141 are positioned on the top of both lateral surfaces of the first tray 121 while being elongated in the longitudinal direction thereof, in order to guide the movement of the second tray 131. The length of the guide members 141, when measured in the forward and backward directions, is preferably smaller than that of the second tray 131.

The guide members 141 are positioned on the rear half of the top of both lateral surfaces 121A of the first tray 121, respectively. Particularly, the front end of each guide member 141 is spaced a predetermined distance from the front end of the top of both lateral surfaces of the first tray 121, and the rear end of each guide member 141 coincides with the rear end of the top of both lateral surfaces of the first tray 121.

The guide members 141 have guide slots 143 elongated in the longitudinal direction thereof, respectively. The front surfaces of the guide slots 143, as well as the lateral surfaces thereof, which face each other, are open. The guide ribs 135 are adapted to slide while being inserted into the guide slots 143.

The latching steps 145 are positioned on the front end of the guide members 141, in order to prevent the second tray 131 from moving beyond a predetermined range in the backward direction relative to the first tray 121. According to the first embodiment of the present invention, the front end of each guide member 141 has a level difference relative to the top of both lateral surfaces of the first tray 121, which corresponds to the thickness, and acts as a latching step 145.

Referring to FIG. 2, the guide members 141 have through-holes 146 formed on one side thereof, respectively, so that the fasteners S extend through the through-holes 146 to be fastened to the fastening holes 126. The through-holes 146 are positioned on the front end of the guide members 141 so as to correspond to the fastening holes 126 when the guide members 141 are installed on the first tray 121.

Each guide member 141 has insertion ribs 147 positioned on both ends 141B, 141C of its bottom surface 141A, respectively. The insertion ribs 147 extend a predetermined distance from both ends 141B, 141C of the bottom surface 141A of the guide members 141 in the downward direction. An insertion groove 147A is formed between facing surfaces of the insertion ribs 147 with a width corresponding to the thickness of both lateral surfaces of the first tray 121. The top of both lateral surfaces 121A of the first tray 121 is inserted into the insertion groove 147A.

The insertion slots 147B are positioned on one side of the insertion ribs 147, which are fastened to the inner side 121B of both lateral surfaces 121A of the first tray 121, respectively. The insertion slots 147B are formed by cutting out parts of the insertion ribs 147 in the vertical direction with a predetermined width. The insertion protrusions 127 are inserted into respective insertion slots 147B.

Referring to FIG. 2 again, the fastening hooks 149 are positioned on the rear end 141B of the bottom surface 141A of the guide members 141 so as to correspond to the rear end of the insertion grooves 147A, respectively. The fastening hooks 149 have a U-shaped configuration, i.e. have an upward opening, so that they engage with the fastening protrusions 128. More particularly, the fastening hooks 149 have an extension portion 149A extending a predetermined distance from the rear end 141B of the bottom surface 141A of the guide members 141 in the downward direction, a horizontal portion 149B extending horizontally from the front end of the extension portion 149A in the forward direction, i.e. towards the inside of the insertion grooves 147A, and a latching portion 149C extending from the front end of the horizontal portion 149B in the upward direction so as to engage with the fastening protrusions 128.

A process for assembling the refrigerator receptacle according to the first embodiment of the present invention will now be described.

The guide members 141 are installed on the first tray 121. The guide members 141 are rotated about their rear end, while the fastening protrusions 128 of the first tray 121 engage with the fastening hooks 149 of the guide members 141, so that the top of both lateral surfaces of the first tray 121 is inserted into each insertion groove 147A of the guide members 141.

In the process of inserting the top of both lateral surfaces of the first tray 121 into each insertion groove 147A of the guide members 141, the insertion protrusions 127 of the first tray 121 are inserted into the insertion slots 147B of the guide member 141. After the top of both lateral surfaces of the first tray 121 is fully inserted into each insertion groove 147A, the fasteners S extend through the through-holes 146 of the first tray 121 to be fastened to the fastening holes 126 of the guide members 141.

In order to install the second tray 131 on the first tray 121, the rear end of the guide ribs 135 of the second tray 131 is positioned horizontally so as to be adjacent to the open front surface of the guide slots 143 of the guide members 141. The second tray 131 is then moved in such a manner that the guide ribs 135 are fully inserted, from their rear end, via the open front surface of the guide slots 143.

The first tray 121 is positioned on the rear surface of the door 115 with the second tray 131 installed thereon. Particularly, the first tray 121 is positioned between the movable rails 119, which are fixed to the rear surface of the door 115.

A process for using the refrigerator receptacle according to the first embodiment of the present invention will now be described in detail with reference to the accompanying drawings.

Figure 3A:
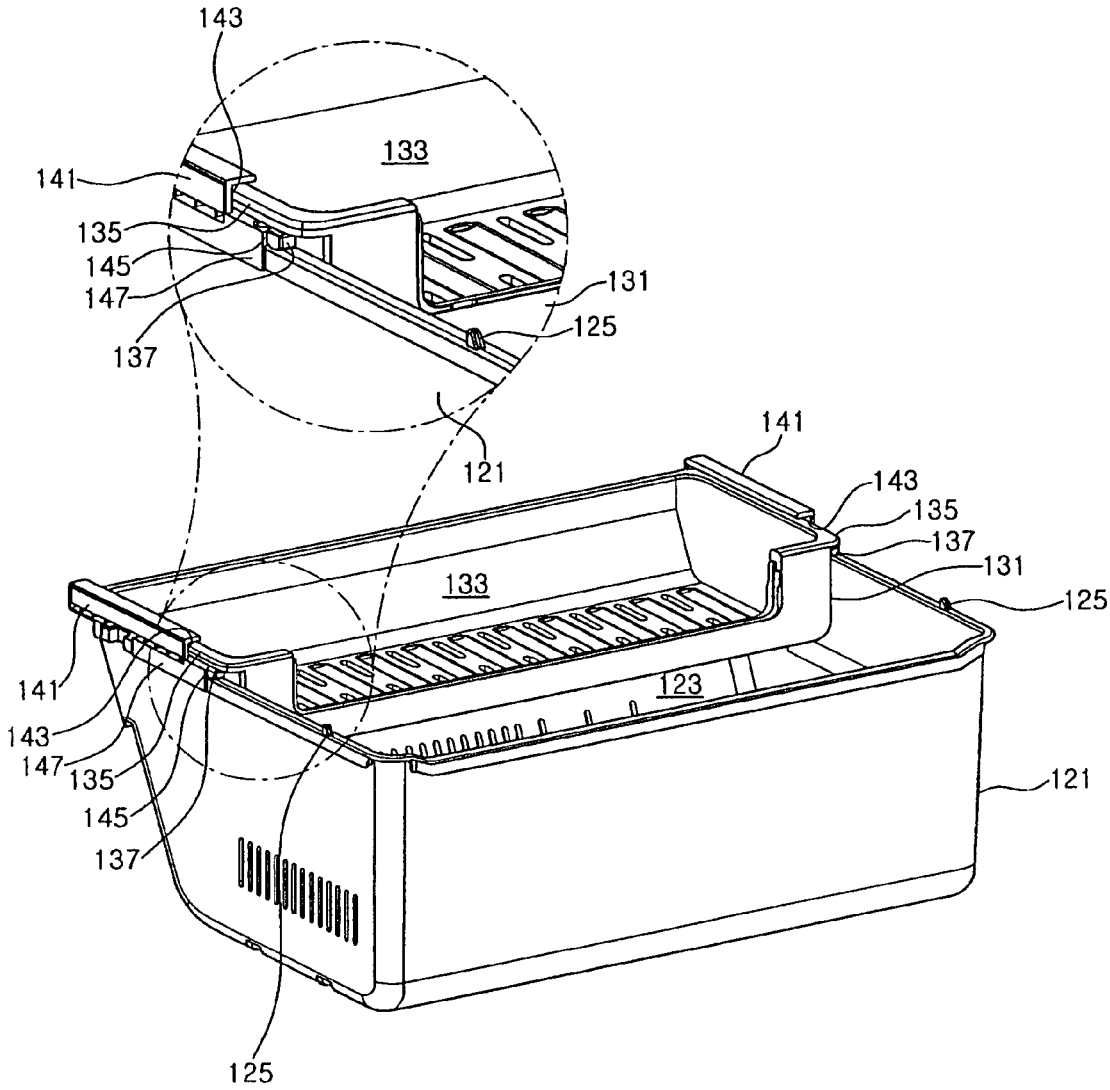
FIGS. 3A and 3B are lateral sectional views showing the operation of the refrigerator receptacle according to the first embodiment of the present invention.
Figure 3B:
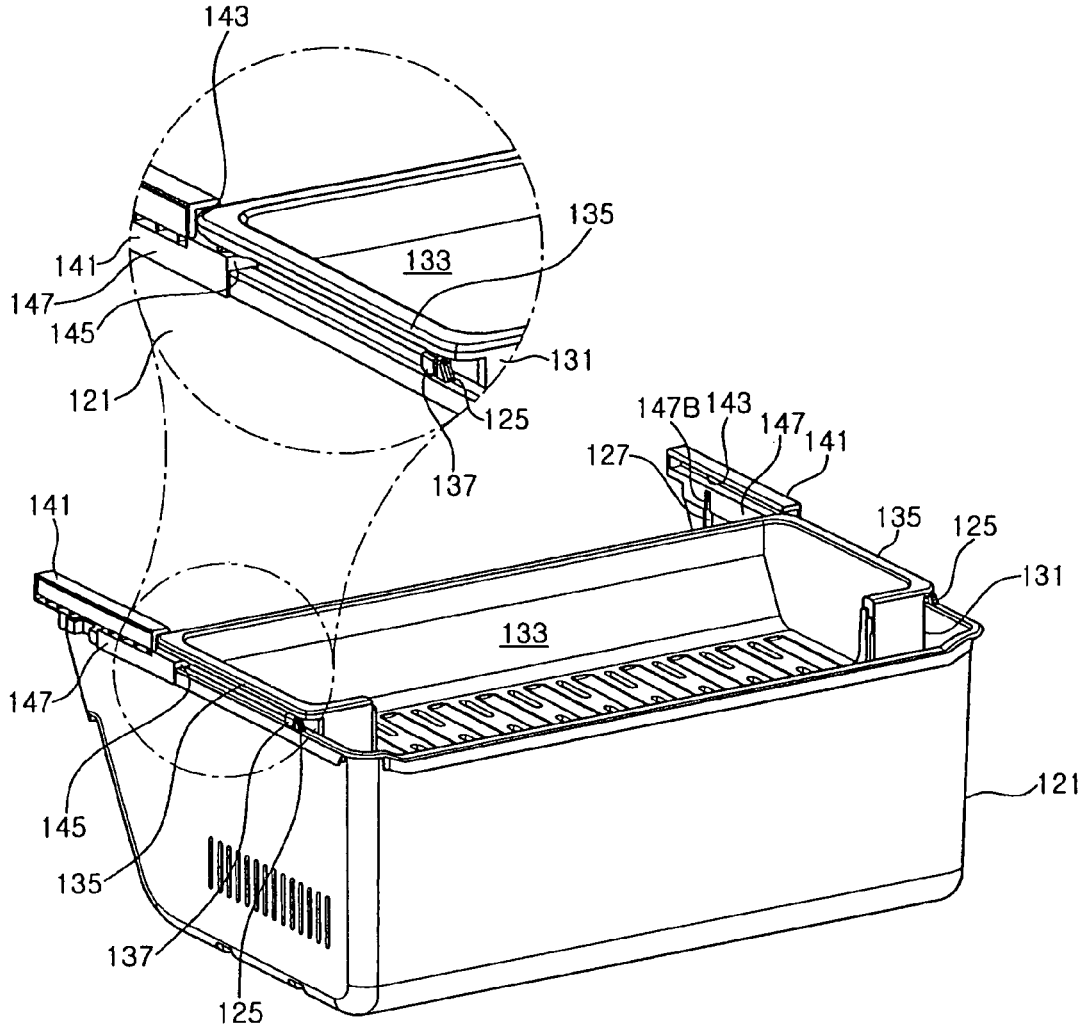

FIGS. 3A and 3B are lateral sectional views showing the operation of the refrigerator receptacle according to the first embodiment of the present invention.

Referring to FIG. 3A, food (not shown) is contained in the reception space 123 of the first tray 121 and the reception space 133 of the second tray 131, respectively. The first and second trays 121 and 131 are then placed into the storage space 111 of the refrigerator body 110.

The guide ribs 135 of the second tray 131 are then fully inserted into the guide slots 143 of the guide members 141. Particularly, the second tray 131 is positioned on the rear end of the first tray 121 so that the stoppers 137 of the second tray 131 abut the latching steps 145 of the guide members 141.

When food is to be put in or removed from the reception space 123 of the first tray 121, the user grasps the door handle 117 of the door 115 by hand and pulls it to the front of the storage space 111. The range of movement of the first tray 121 is preferably limited lest the first tray 121 should fully move out of the storage space 111.

Particularly, only a part of the first tray 121 is moved out of the storage space 111, as shown in FIG. 3A. In this case, the second tray 131 is still inside the storage space 111. This means that food can neither be put into nor removed from the reception space 133 of the second tray 131. Therefore, when food is to be put in or removed from the reception space 133 of the second tray 131, the second tray 131 is moved out of the storage space 111 by pulling it away from the first tray 121, i.e. to the front of the storage space 111, as shown in FIG. 3B.

The guide ribs 135 slide while being inserted into the guide slots 143. When the second tray 131 is drawn out of the storage space 111, the stopper 137 moves away from the latching steps 145 of the guide members 141 until they abut the latching protrusions 125 of the first tray 121.

After the second tray 131 is drawn out of the storage space 111, the user can easily put food in the reception space 133 of the second tray 131 or remove food therefrom. After food is put or removed in this manner, the first and second trays 121 and 131 are placed into the storage space 111 in the reverse order.

The construction of a refrigerator receptacle according to a second embodiment of the present invention will now be described in detail with reference to the accompanying drawings.

Figure 4:
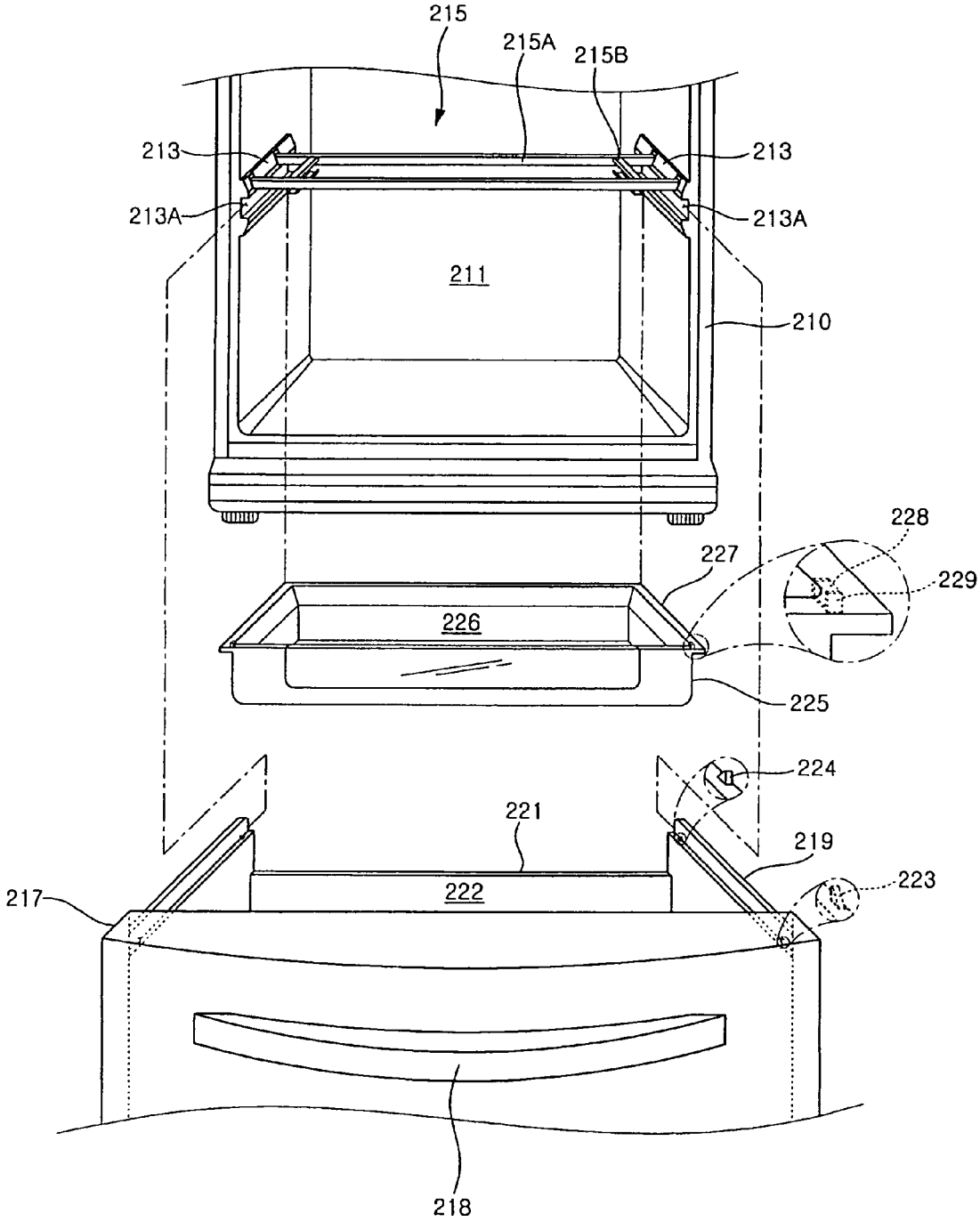
FIG. 4 is an exploded perspective view showing a refrigerator receptacle according to a second embodiment of the present invention.
Figure 5:
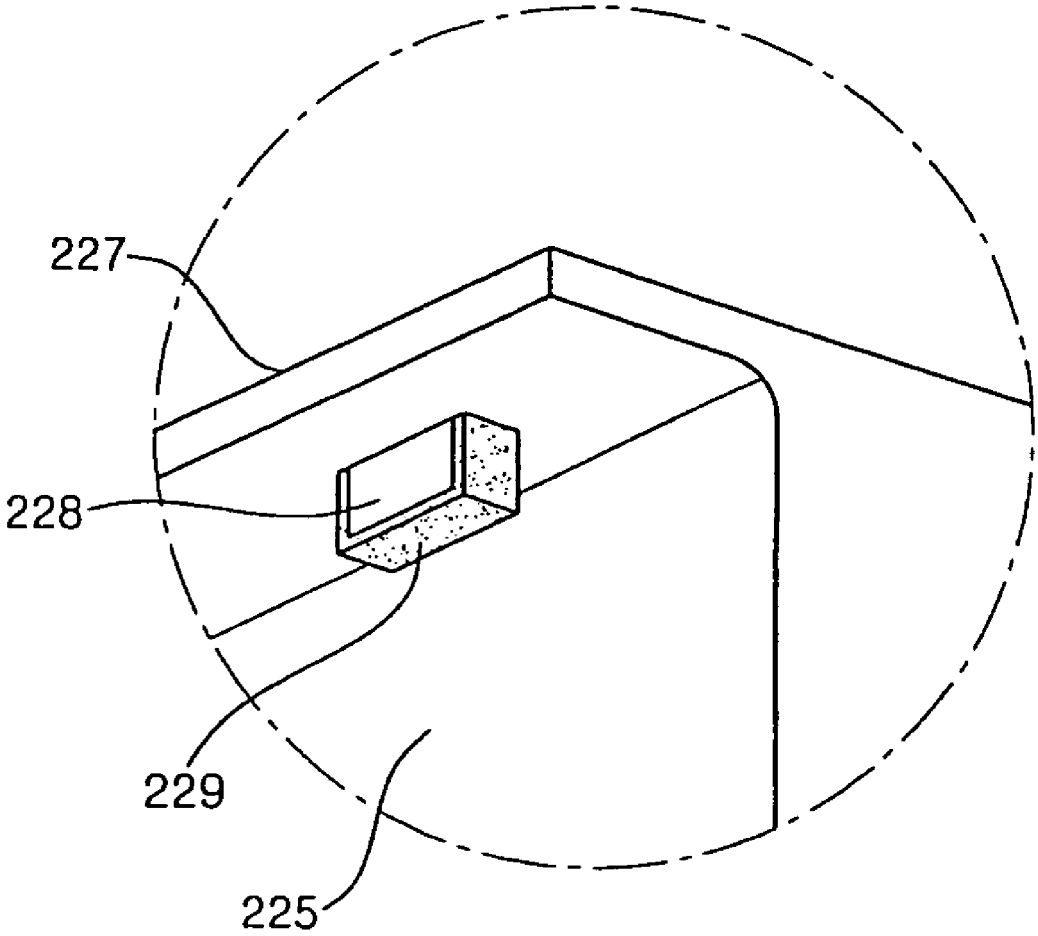
FIG. 5 is a perspective view partially showing the refrigerator receptacle according to the second embodiment of the present invention.
Figure 6:
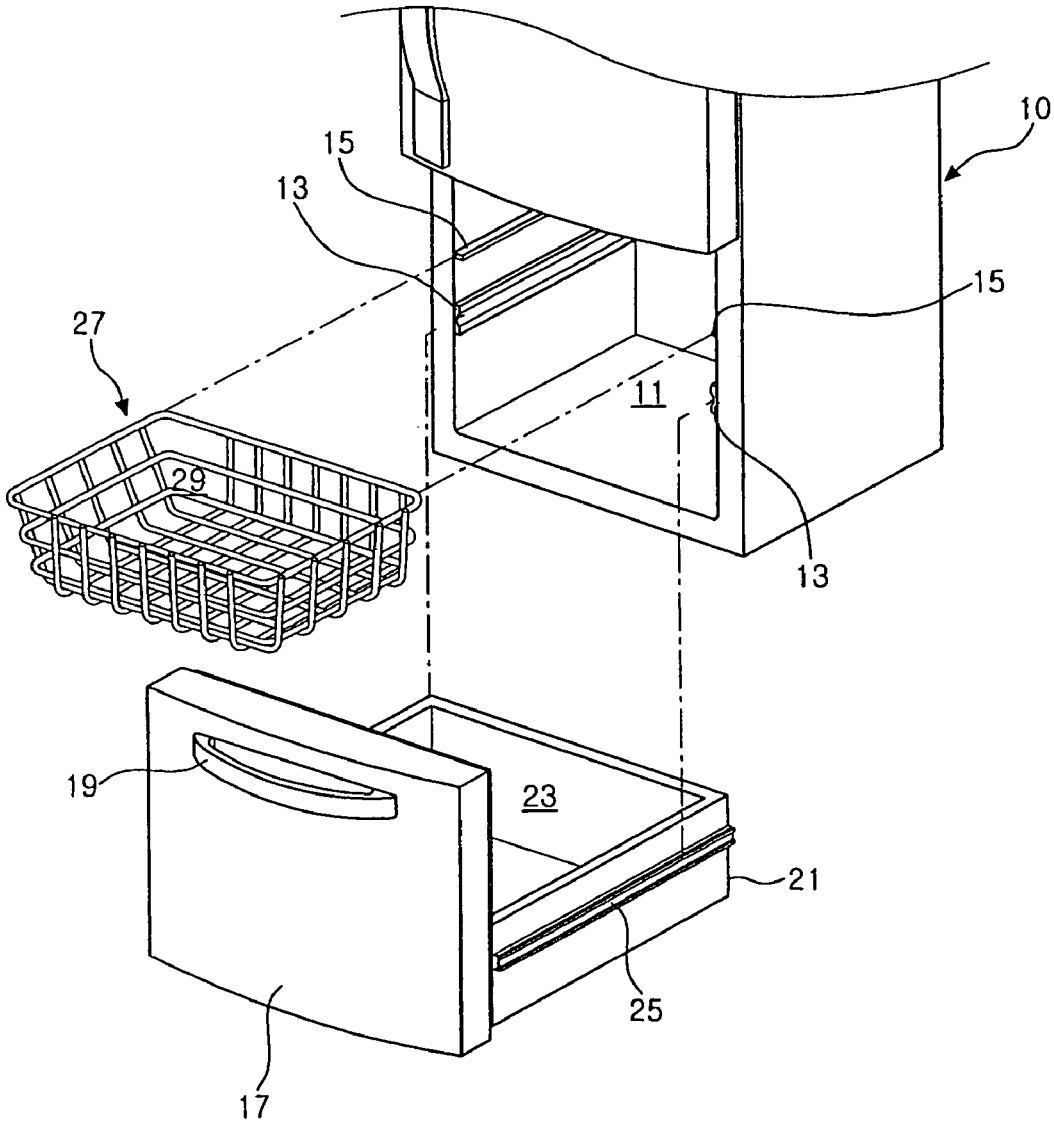
FIG. 6 Related Art
FIG. 6 is an exploded perspective view showing a conventional refrigerator receptacle.

FIG. 4 is an exploded perspective view briefly showing a refrigerator provided with a refrigerator receptacle according to a second embodiment of the present invention, and FIG. 5 is a perspective view partially showing the refrigerator receptacle according to the second embodiment of the present invention.

Referring to the drawings, a refrigerator body 210 has a storage space 211 defined therein and fixed rails 213 positioned on both lateral surfaces of the storage space 211, respectively, while being elongated forwards and backwards. The fixed rails 213 guide the inward/outward movement of a basket 221 (described later).

The fixed rails 213 have guide grooves 213A formed on their surfaces facing each other. Movable rails (not shown) of a basket frame 219 (described later) are inserted into the guide grooves 213A so as to slide therein. Particularly, the guide grooves 213A are formed by indenting surfaces of the fixed rails 213, which face each other, in such a manner that they are elongated in the longitudinal direction of the fixed rails 213.

A guide frame 215 is positioned in the storage space 211, in order to guide the inward/outward movement of a tray 225 (described later). The guide frame 215 consists of a pair of connection bars 215A extending horizontally and a pair of guide bars 215B positioned beneath the connection bars 215A while being elongated in the forward and backward directions.

Both ends of the connection bars 215A extend through portions of the fixed rails 213 above the guide grooves 213A and are fixed to both lateral surfaces of the storage space 211, respectively. Particularly, the connection bars 215A are fixed to the front and rear ends of the storage space 211, respectively, while being spaced a predetermined distance from each other in the forward and backward directions.

The guide bars 215B are positioned on both ends of the connection bars 215A adjacent to the guide grooves 213A of the fixed rails 213. The guide bars 215B have a U-shaped cross section with an opening facing each other so that guide ribs 227 of the tray 225 can slide while being seated therein.

The refrigerator body 210 has a door 217 for selectively exposing/covering the storage space 211. The door 217 has a door handle 218 positioned on its front surface near its top so that the user can grasp the door handle 218 and open/close the door 217. The door 217 has a basket frame 219 connected to its rear surface in such a manner that the front end of the basket frame 219 can tilt about the lower end thereof within a predetermined angular range in the forward and backward directions of the body 210.

The basket frame 219 has movable rails positioned on both outer surfaces thereof while being elongated in the forward and backward directions so that they can slide along the fixed rails 213 while being inserted into the guide grooves 213A of the fixed rails 213.

The basket 221 is removably positioned on the basket frame 219 and has a reception space 222 positioned therein, which has an upward opening. As magnified in FIG. 4, the basket 221 has pairs of interlocking protrusions 223 and 224 positioned on the front and rear ends of the top of both lateral surfaces thereof, respectively.

The interlocking protrusions 223 and 224 are interlocked with the movement of the basket 221 into/out of the storage space 211 so that the tray 225 is moved into/out of the storage space 211. Particularly, the interlocking protrusions 223 and 224 consist of inward-movement interlocking protrusions 223 protruding a predetermined distance from the front end of the top of both lateral surfaces of the basket 221 and outward-movement interlocking protrusions 224 protruding a predetermined distance from the rear end of the top of both lateral surfaces thereof.

The tray 225 is positioned above the basket 221 so as to move into/out of the storage space 211 while being interlocked with the inward/outward movement of the basket 221. The tray 225 has a reception space 226 defined therein, which has an upward opening.

The tray 225 has guide ribs 227 positioned on the top of both lateral surfaces thereof, in order to guide the inward/outward movement of the tray 225. Particularly, the guide ribs 227 extend outwards from the top of both lateral surfaces of the tray 225 so that they can slide while being seated on the guide bars 215B of the guide frames 215 or on the top of both lateral surfaces of the basket 221.

As shown in FIG. 4, the guide ribs 227 have latching protrusions 228 positioned on the front end of the bottom surface thereof, respectively. The latching protrusions 228 protrude a predetermined distance from the front end of the bottom surface of the guide ribs 227 in the downward direction. The latching protrusions 228 are selectively pushed by the interlocking protrusions 223 and 224 so as to move the tray 225 into/out of the storage space 211 while being interlocked with the inward/outward movement of the basket 221.

More particularly, when the basket 221 is moved out of the storage space 211, the latching protrusions 228 are pushed to the outside of the storage space 211 with their rear surface being forced against the front surface of the outward-movement interlocking protrusions 224. When the basket 221 is moved into the storage space 211, the front surface of the latching protrusions 228 is pushed to the inside of the storage space 211 by the rear surface of the inward-movement interlocking protrusions 223. The lower end of the latching protrusions 228 is forced against the guide bars 215B or the top of both lateral surfaces of the basket 221 when the guide ribs 227 slide along the guide bars 215B or the top of both lateral surfaces of the basket 221.

The guide ribs 227 have buffering members 229 positioned on their bottom surface so as to enclose the latching protrusions 228. The buffering members 229 are interlocked with the inward/outward movement of the basket 221 and absorb external force acting on the latching protrusions 228 when the tray 225 is moved into/out of the storage space 211. Particularly, when the latching protrusions 228 are pushed by the interlocking protrusions 223 and 224, or when they slide while being seated on the guide bars 215B or the top of both lateral surfaces of the basket 221, the buffering members 229 are forced against the interlocking protrusions 223 and 224, the guide bars 215B, or the top of both lateral surfaces of the basket 221 so that external force acting on the latching protrusions 228 is absorbed.

To this end, the buffering members 229 are made of a material having a predetermined degree of elasticity, such as rubber, in a U-shaped configuration so as to enclose the front, rear, and bottom surfaces of the latching protrusions 228. The buffering members 229 may be fixed to the bottom surface of the guide ribs 227 with adhesive, for example. Alternatively, the buffering members 229 may be fixed to the bottom surfaces of the guide ribs 227, as well as to the front, rear, and bottom surfaces of the latching protrusions 228.

A process for moving the tray into/out of the storage space of the refrigerator receptacle according to the second embodiment of the present invention will now be described.

The door 217 is pulled to the front of the storage space 211 by grasping the door handle 218. As a result, the storage space 211 is exposed. In addition, the movable rails of the basket frame 219 on the rear surface of the door 217 slide to the front of the storage space 211 while being inserted into the guide grooves 213A of the fixed rails 213 on both sides of the storage space 211.

As such, the basket 221 on the basket frame 219 is moved out of the storage space 211 as soon as the storage space 211 is exposed by the door 217. The user then can put food in the reception space 222 of the basket 221 or remove food therefrom. In this case, the door 217 is tilted at an angle relative to the basket frame 219 so that food can be put or removed more easily.

When the basket 221 is moved out of the storage space 211, the outward-movement interlocking protrusions 224 on the rear end of the top of both lateral surfaces of the basket 221 travel to the front of the storage space 211 until they abut one side of the buffering members 229, which corresponds to the front surface of the latching protrusions 228 positioned on the guide ribs 227 of the tray 225. After the basket 221 is moved out of the storage space 211, the outward-movement interlocking protrusions 224 push the latching protrusions 228 in the same direction as the basket 221 is drawn out of the storage space 211.

As such, the tray 225, particularly a part of the front end of the tray 225, is moved out of the storage space 211 while being interlocked with the outward movement of the basket 221. The guide ribs 227 of the tray 225 slide along the guide bars 215B while one side of the buffering members 229, which corresponds to the bottom surface of the latching protrusions 228, is forced against the guide bars 215B of the guide frames 215 of the storage space 211.

When the tray 225 is to be fully moved out of the storage space 211 while a part of the front end of the tray 225 is outside of the storage space 211, the tray 225 is pulled to the front of the storage space 211. Then, the guide ribs 227 slide along the top of both lateral surfaces of the basket 221 while one side of the buffering members 229, which corresponds to the bottom surface of the latching protrusions 228, is forced against the top of both lateral surfaces of the basket 221. After the tray 225 is fully moved out of the storage space 211, one side of the buffering members 229, which corresponds to the front surface of the latching protrusions 228, abuts the rear surface of the inward-movement interlocking protrusions 224 on the front end of the top of both lateral surfaces of the basket 221.

Now that the tray 225 is fully out of the storage space 211, food can be put in the reception space 226 of the tray 225 or removed therefrom. In this case, the reception space 222 of the basket 221 is still covered by the tray 225. This means that, in order to put food in the reception space 222 or remove food therefrom, the tray 225 must be moved into the storage space 211.

After putting food in or removing food from the reception space 222 of the basket 221 and/or the reception space 226 of the tray 225, the basket 221 and the tray 225 are moved into the storage space 211 in the reverse order.

Particularly, the door 217 is pushed into the storage space 211 so that the movable rails slide while being seated in the guide grooves 213A. The basket 221 then begins to move into the storage space 211. The latching protrusions 228 are pushed into the storage space 211 by the inward-movement interlocking protrusions 223 while one side of the buffering members 229, which corresponds to the front surface of the latching protrusions 228, is forced against the rear surface of the inward-movement interlocking protrusions 223.

As such, the tray 225 begins to move into the storage space 211 while being interlocked with the inward movement of the basket 221. The guide ribs 227 slide along the guide bars 215B while one side of the buffering members 229, which corresponds to the bottom surface of the latching protrusions 228, is forced against the guide bars 225B.

The door 217 is continuously pushed into the storage space 211 until the basket 221 is fully inside the storage space 211. The tray 225 is also fully moved into the storage space 211 while being interlocked with the inward movement of the basket 221.

As mentioned above, the inventive refrigerator receptacle has the following advantages.

The first and second trays can be moved out of the storage space in a single operation, so that food can be put in the storage space or removed therefrom in an easy and convenient manner.

The second tray is adapted to move in the same direction as the first tray moves inwards/outwards by the guide members on the top of both lateral surfaces of the first tray. This prevents food contained in the first tray from being damaged by the second tray when the first tray moves inwards/outwards or when the second tray is moved.

The buffering members enclose the latching protrusions, which are forced against the guide bars, the top of both lateral surfaces of the basket, and the interlocking protrusions when the tray is moved inwards/outwards. This minimizes noise generated by the tray when it is moved into/out of the storage space while being interlocked with the inward/outward movement of the basket, thereby providing a user-friendly environment.

The buffering members absorb external force acting on the latching protrusions when the tray is moved inwards/outwards. This prevents the latching protrusions or the interlocking protrusions from being damaged and improves the durability.

Although a preferred embodiment of the present invention has been described for illustrative purposes, those skilled in the art will appreciate that various modifications, additions and substitutions are possible, without departing from the scope and spirit of the invention as disclosed in the accompanying claims

What is claimed is:

1. A refrigerator receptacle, comprising:

a first tray having a plurality of lateral surfaces and adapted to move into and out of a storage space like a drawer, a first reception space being defined in the first tray, the first reception space having an upwardly extending opening;

a second tray adapted to move in an inward and outward movement direction of the first tray, a second reception space being defined in the second tray, the second reception space having an upwardly extending opening;

a plurality of guide members that guides movement of the second tray, an insertion groove being formed on each of the plurality of guide members, an upper end of each of the plurality of lateral surfaces of the first tray being inserted into the insertion groove of a respective one of the plurality of guide members, wherein the insertion grooves are each formed by an insertion rib that extends downward from a bottom surface of the respective guide member, wherein elongated insertion protrusions are formed vertically on each of the plurality of lateral surfaces of the first tray and insertion slots corresponding to the insertion protrusions are formed on the insertion ribs of the plurality of guide members so that the insertion protrusions are inserted into the insertion slots, wherein the insertion protrusions protrude toward each other from an inner side of each of the plurality of lateral surfaces of the first tray and the insertion slots are formed by vertically removing portions of the insertion ribs of the plurality of guide members, and wherein fastening protrusions are formed on a rear end of the first tray and fastening hooks are formed on a rear end of the plurality of guide members corresponding to the fastening protrusions so that the fastening protrusions and the fastening hooks engage with each other; and a plurality of fasteners, each extending through one of the first tray and a respective one of the plurality of guide members so as to be fastened to the other of the first tray and the respective guide member;

wherein the fastening protrusions extend at a downward angle in a backward direction from a rear end of the upper end of each of the plurality of lateral surfaces of the first tray, and the fastening hooks have a U-shaped configuration with an upwardly extending opening so as to engage with the fastening protrusions, each of the fastening hooks comprising:

an extension portion that extends a predetermined distance downward from a rear end of a bottom surface of the respective guide member;

a horizontal portion that extends a predetermined distance horizontally from a leading end of the extension portion toward a front end of the respective guide member; and a latching portion that extends a predetermined distance upward from a leading end of the horizontal portion.

2. The refrigerator receptacle as claimed in claim 1, wherein the respective fastener extends through a through-hole formed on a leading end of each guide member so that the respective fastener is fastened to a fastening hole formed on the upper end of the respective one of the plurality of lateral surfaces of the first tray.

3. The refrigerator receptacle as claimed in claim 1, wherein the first tray is configured to be positioned on a rear surface of a door that selectively exposes and covers the storage space.

4. The refrigerator receptacle as claimed in claim 1, wherein each of the plurality of guide members further comprises a guide slot configured to receive a guide rib of a respective one of a plurality of lateral surfaces of the second tray.

5. A refrigerator comprising the refrigerator receptacle as claimed in claim 1.

6. A refrigerator receptacle, comprising:

a first tray having a plurality of lateral surfaces and adapted to move into and out of a storage space like a drawer, a first reception space being defined in the first tray, the first reception space having an upwardly extending opening;

a second tray having a plurality of second lateral surfaces and adapted to move in an inward and outward movement direction of the first tray, a second reception space being defined in the second tray, the second reception space having an upwardly extending opening, the second tray including guide ribs positioned on a top of both second lateral surfaces;

a plurality of guide members that guides movement of the second tray, an insertion groove being formed on each of the plurality of guide members, an upper end of each of the plurality of lateral surfaces of the first tray being inserted into the insertion groove of a respective one of the plurality of guide members, wherein the insertion grooves are each formed by an insertion rib that extends downward from a bottom surface of the respective guide member, wherein elongated insertion protrusions are formed vertically on each of the plurality of lateral surfaces of the first tray and insertion slots corresponding to the insertion protrusions are formed on the insertion ribs of the plurality of guide members so that the insertion protrusions are inserted into the insertion slots, wherein the insertion protrusions protrude toward each other from an inner side of each of the plurality of lateral surfaces of the first tray and the insertion slots are formed by vertically removing portions of the insertion ribs of the plurality of guide members, and wherein fastening protrusions are formed on a rear end of the first tray and fastening hooks are formed on a rear end of the plurality of guide members corresponding to the fastening protrusions so that the fastening protrusions and the fastening hooks engage with each other; and a plurality of fasteners, each extending through one of the first tray and a respective one of the plurality of guide members so as to be fastened to the other of the first tray and the respective guide member;

wherein the first tray further comprises at least one latching protrusion that extends in an upward direction from at least one of the plurality of lateral surfaces, the at least one latching protrusion limiting a range of movement of the second tray by engaging with at least one stopper provided on one of the guide ribs of the second tray.

* * * * *